US009723912B2

(12) United States Patent
Chun et al.

(10) Patent No.: US 9,723,912 B2
(45) Date of Patent: Aug. 8, 2017

(54) TOOTHBRUSH APPARATUS WITH AN ARCUATE TOOTHBRUSH HEAD AND BRISTLE CONFIGURATION

(71) Applicant: Hankookin, Inc, Raleigh, NC (US)

(72) Inventors: James Jiwen Chun, Raleigh, NC (US); Andrew Youngho Chun, Raleigh, NC (US); Angela Soyoung Chun, Raleigh, NC (US); Jennifer Miseong Chun, Raleigh, NC (US)

(73) Assignee: HANKOOKIN, INC., Raleigh, NC (US)

( * ) Notice: Subject to any disclaimer, the term of this patent is extended or adjusted under 35 U.S.C. 154(b) by 663 days.

(21) Appl. No.: 14/135,598

(22) Filed: Dec. 20, 2013

(65) Prior Publication Data

US 2014/0101881 A1 Apr. 17, 2014

Related U.S. Application Data

(63) Continuation-in-part of application No. 13/027,330, filed on Feb. 15, 2011, now Pat. No. 8,635,734.

(51) Int. Cl.

| | |
|---|---|
| ***A46B 7/04*** | (2006.01) |
| ***A46B 9/04*** | (2006.01) |
| ***A46B 9/02*** | (2006.01) |
| ***A46D 1/00*** | (2006.01) |

(52) U.S. Cl.

CPC ..... *A46B 9/04* (2013.01); *A46B 7/04* (2013.01); *A46B 9/026* (2013.01); *A46B 9/028* (2013.01); *A46D 1/0238* (2013.01); *A46D 1/0276* (2013.01); *A46D 1/0284* (2013.01); *A46B 2200/1066* (2013.01)

(58) Field of Classification Search

CPC ..... A46B 7/04; A46B 9/026; A46B 9/028; A46B 9/04; A46B 7/042

See application file for complete search history.

(56) References Cited

U.S. PATENT DOCUMENTS

| | | | | | |
|---|---|---|---|---|---|
| 1,414,886 | A | * | 5/1922 | Matsunaga | A46B 7/04 15/176.4 |
| 4,288,883 | A | * | 9/1981 | Dolinsky | A46B 9/026 15/110 |
| 5,305,489 | A | * | 4/1994 | Lage | A46B 5/02 15/143.1 |

(Continued)

*Primary Examiner* — Randall Chin

(74) *Attorney, Agent, or Firm* — Ash Tankha; Lipton, Weinberger & Husick

(57) ABSTRACT

A toothbrush apparatus includes a handle with a longitudinal axis and a toothbrush head constructed and arranged to hold multiple bristles. The bristles are formed in a non-circular configuration. The non-circular configuration is on a distal end, or a portion including the distal end, or the entire bristle. A wall defining an elongated bristle body of each bristle tapers from a base end towards a chisel end of the elongated bristle body. The toothbrush head is of an arcuate shape that conforms to a dental arch. The toothbrush apparatus includes one or more bristle carriers for detachably attaching multiple bristles to the toothbrush head. The second end of each of the bristles of predetermined heights defines a first curved trim profile and a perpendicular second curved trim profile. The bristles in the first curved trim profile at a terminal end of the toothbrush head are extended to reach rear teeth.

3 Claims, 18 Drawing Sheets

(56) References Cited

U.S. PATENT DOCUMENTS

| | | | | |
|---|---|---|---|---|
| 6,338,176 | B1 * | 1/2002 | Smith | A46B 7/08 15/167.1 |
| 6,988,777 | B2 * | 1/2006 | Pfenniger | A46B 3/06 15/167.1 |
| 2005/0188489 | A1 * | 9/2005 | Hohlbein | A46B 3/20 15/167.1 |
| 2009/0056737 | A1 * | 3/2009 | Neuner | A45D 40/265 132/218 |
| 2010/0306941 | A1 * | 12/2010 | Erskine-Smith | A46B 9/026 15/167.1 |
| 2010/0325827 | A1 * | 12/2010 | Huang | A46B 9/028 15/167.1 |

* cited by examiner

TOOTHBRUSH APPARATUS WITH AN ARCUATE TOOTHBRUSH HEAD AND BRISTLE CONFIGURATION

CROSS REFERENCE TO RELATED APPLICATIONS

This application is a continuation-in-part application of non-provisional patent application Ser. No. 13/027,330, now U.S. Pat. No. 8,635,764, titled "Toothbrush With Bristles Of Non Circular Tips", filed in the United States Patent and Trademark Office on Feb. 15, 2011. The specification of the above referenced patent application is incorporated herein by reference in its entirety.

BACKGROUND

Dental health and hygiene is an area that is still evolving and undergoing many improvements. The toothbrush has seen numerous improvements and advancements in recent years. For cleaning teeth, the tooth brushing technique recommended by the American Dental Association (ADA) and most dentists is to tilt the toothbrush, for example, at about a 45° angle against the gum line and with gentle force, brush forward and backward with a short vibratory movement, and sweep or roll the toothbrush away from the gum line. More force should be applied in the rolling or sweeping movements to remove plaque and debris between the teeth. The efficacy of tooth brushing remains an unpublicized but pressing issue.

In fact, most people brush with a circling motion. According to a research article by C. Ganss, N. Schlueter, S. Preiss, and J. Klimek (Clinical Oral Investigations, Volume 13, Number 2, 203-208, 2008), the mean brushing force was, for example, about 2.3±0.7 Newton (N) with a maximum force of about 4.1 N. Most subjects, for example, about 73.8%, brushed with a circling motion, about 8.7% brushed with horizontal/scrubbing movements, about 13.6% brushed with horizontal/circling movements, and about 3.9% brushed with vertical sweeping movements. Many electric toothbrushes such as Oral-B® of Procter & Gamble Business Services Canada Company Corporation also use a circular brushing motion. Thus, there is a discrepancy between the ADA recommendation and the common brushing techniques.

Vigorous tooth brushing can cause gum and root recession, tooth sensitivity, and tooth abrasion such as wedge shape defects and dental erosion. Even though most dentists recommend using toothbrushes with soft or medium bristles, tooth abrasion is still very common among people with over vigorous oral hygiene habits. Horizontal defects are mostly due to the brushing force in a forward direction and a backward direction across the teeth surface, and this is the reason for the emphasis placed by the ADA on the sweeping or rolling motion for brushing the plaque and debris away from the gum line.

In addition to the angle of brushing and the brushing force, the shape of a toothbrush head and the configuration of the bristles also affect proper brushing of different portions of the teeth. For example, a rear portion of the third molar tooth is typically not properly brushed owing to the shape and location of the third molar tooth. Conventional toothbrushes generally have straight toothbrush heads with bristles of a uniform height having flat bristle ends. The flat bristle ends fail to conform to the surface curvature of teeth and fail to reach certain portions of the teeth structure, for example, the rear end of the third molar tooth. A toothbrush with a toothbrush head that conforms to a dental arch, and that has a bristle configuration that can reach any section around the teeth structure to facilitate complete and efficient brushing is not available in the market.

Hence, there is a long felt but unresolved need for a toothbrush apparatus with an arcuate toothbrush head and bristle configuration that conforms to a dental arch and to the surface curvature of teeth and that can reach any portion around the teeth structure to facilitate complete and efficient brushing.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The toothbrush apparatus disclosed herein addresses the above mentioned deficiencies by providing a geometric configuration to the shape of a toothbrush bristle to reduce a brushing force in a horizontal forward and backward direction, with an emphasis on a sweeping or rolling force during brushing. Instead of using a commonly used bristle with a round cross section, bristles with an oval cross section are provided and a major axis of the oval cross section of each of the bristles is aligned perpendicular to a longitudinal axis of the brush handle. The toothbrush apparatus disclosed herein also has an arcuate toothbrush head and bristle configuration that conforms to a dental arch and to the surface curvature of teeth and that can reach any portion around the teeth structure to facilitate complete and efficient brushing. As used herein, the phrase "dental arch" refers to a curved orientation of teeth on an upper jaw and a lower jaw of a mouth.

The toothbrush apparatus disclosed herein comprises a handle, a toothbrush head, and multiple bristles. The handle has a longitudinal axis. The toothbrush head is constructed and arranged to hold the bristles. The bristles are formed in a non-circular configuration as viewed from a first end, that is, a proximal end that is attached to the toothbrush head, from a second end, where the second end is a distal end that is not connected to the toothbrush head and is configured to contact the teeth during brushing, or in a cross section from some area along the length of the bristle. In an embodiment, the bristles are circular for some portion of the bristle body and the distal end or the second end has the non-circular configuration.

In an embodiment, the non-circular configuration of the bristles is an elliptical configuration as viewed from any of the first end, the second end, or along the cross section of the bristles. If the bristles are circular with a non-circular configuration at the distal end, the non-circular configuration is viewed from the second end or in the cross section near the distal end. The elliptical configuration of the bristles is defined by a geometric eccentricity greater than 0. The elliptical configuration has a major axis perpendicular to the longitudinal axis. In an embodiment, the toothbrush apparatus disclosed herein further comprises a circular socket with bristles placed thereon. In an embodiment, the bristles are inserted into a non-circular socket.

The toothbrush bristle of the toothbrush apparatus disclosed herein comprises a continuous elongated bristle body and a continuous wall defining the continuous elongated bristle body. The bristle has a cylindrical non-circular distal end. The non-circular portion may be on the distal end of the bristle, a portion including the end of the bristle, or may extend along the entire length of the bristle. The non-circular portion extends for less than the entire length of the bristle, and the remaining portion is circular. In an embodiment, the non-circular portion extends, for example, from about 1% to about 20% of the entire length of the bristle. As disclosed herein, the term "non-circular" includes elliptical and oval configurations.

Disclosed herein is a bristle comprising an elongated bristle body and a wall. The elongated bristle body has a first end herein also referred to as a "base end", and a second end herein also referred to as a "distal end" that opposes the base end. The wall defines the elongated bristle body. The wall continuously tapers from the first end towards the second end. In an embodiment, the cross section of the elongated bristle body at the first end is greater than the cross section of the elongated bristle body at the second end. In an embodiment, the second end of the elongated bristle body defines a plane surface, where the plane surface is perpendicular to a line extending along a length of the elongated bristle body. In another embodiment, the plane surface of the second end is inclined with respect to a line extending along the length of the elongated bristle body. In an embodiment, the first end of the elongated bristle body is adapted to be attached to the toothbrush head of the toothbrush apparatus disclosed herein.

Disclosed herein is a toothbrush apparatus comprising a generally arcuate toothbrush head, one or more bristle carriers, and multiple bristles. The arcuate toothbrush head conforms to a dental arch. The arcuate toothbrush head is of a curvedly tapering thickness towards the terminal end of the arcuate toothbrush head along the longitudinal axis of the toothbrush apparatus. The arcuate toothbrush head comprises one or more base sections on an upper surface of the arcuate toothbrush head. One or more bristle carriers are detachably attached to one or more base sections on the upper surface of the arcuate toothbrush head. Multiple bristles of predetermined heights are attached to each of the bristle carriers. Each bristle has a first end and an opposing second end. The first end of each bristle is attached to a bristle carrier. The second end of each of the bristles of predetermined heights is configured to define a first curved trim profile along a longitudinal axis of the toothbrush apparatus, and a second curved trim profile substantially perpendicular to the longitudinal axis of the toothbrush apparatus. As used herein, the phrase "curved trim profile" refers to a curved profile defined by trimming distal ends of a cluster of bristles. The bristles in the first curved trim profile, positioned proximal to a terminal end of the arcuate toothbrush head, are configured to extend to reach a rear section of rear teeth along the dental arch.

In an embodiment, the bristles in the first curved trim profile positioned proximal to an opposing end of the terminal end of the arcuate toothbrush head are of heights lower than heights of the bristles positioned proximal to the terminal end of the arcuate toothbrush head. The bristles in the first curved trim profile positioned proximal to the opposing end of the terminal end of the arcuate toothbrush head are configured to reach a frontal section of the rear teeth and frontal teeth. The second curved trim profile which is substantially perpendicular to the longitudinal axis of the toothbrush apparatus conforms to a surface curvature of the teeth.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific structures disclosed herein. The description of a structure referenced by a numeral in a drawing carries over to the description of that structure shown by that same numeral in any subsequent drawing herein.

DETAILED DESCRIPTION OF THE INVENTION

Figure 1:
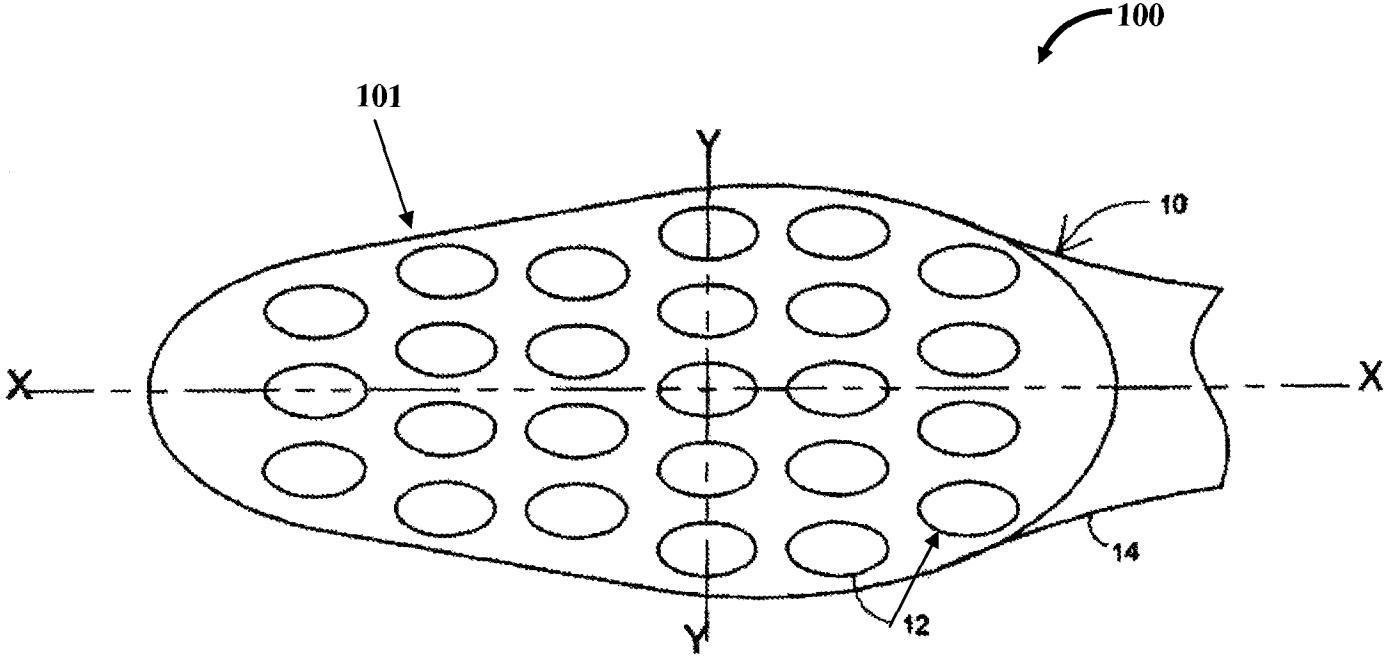
FIG. 1 exemplarily illustrates a plan view of an embodiment of a toothbrush apparatus, where bristles are arranged in elliptical bundles along a longitudinal axis XX.

The toothbrush bristles of the toothbrush apparatus 100 exemplarily illustrated in FIG. 1 relates to a geometric configuration of individual bristle fibers. While all bristles conventionally utilized are cylindrical, for example, having a circular cross section, the toothbrush apparatus 100 disclosed herein provides for curved cylindrical bristles 12 and 16 having a non-circular configuration as exemplarily illustrated in FIGS. 1-2. As used herein, the phrase "curved cylinder" describes the geometric configuration of curved cylindrical bristles 12 and 16 that do not have a circular cross section. The curved cylinder geometric configuration includes all elliptical and oval configurations. The toothbrush apparatus 100 disclosed herein includes toothbrush bristles, for example, 12 and 16 formed of materials known in the art and relates is particular to the geometric configuration and not the material composition.

Figure 5:
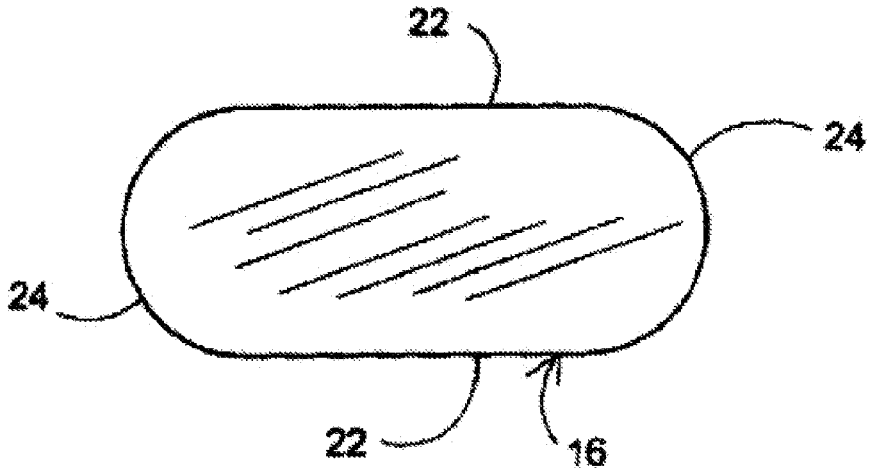
FIG. 5 exemplarily illustrates a top view of a single oval bristle.
Figure 6:
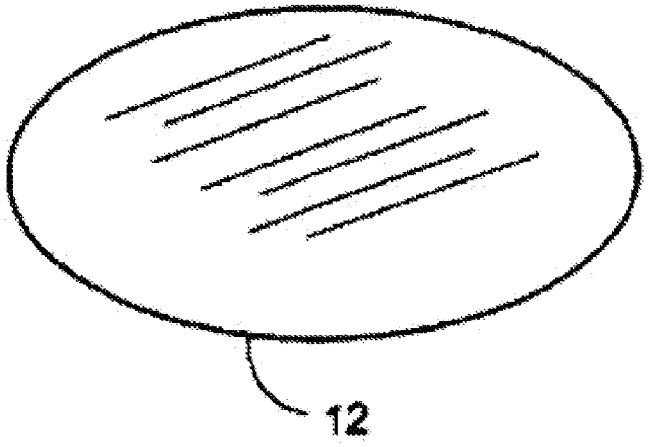
FIG. 6 exemplarily illustrates a top view of a single elliptical bristle.
Figure 13:
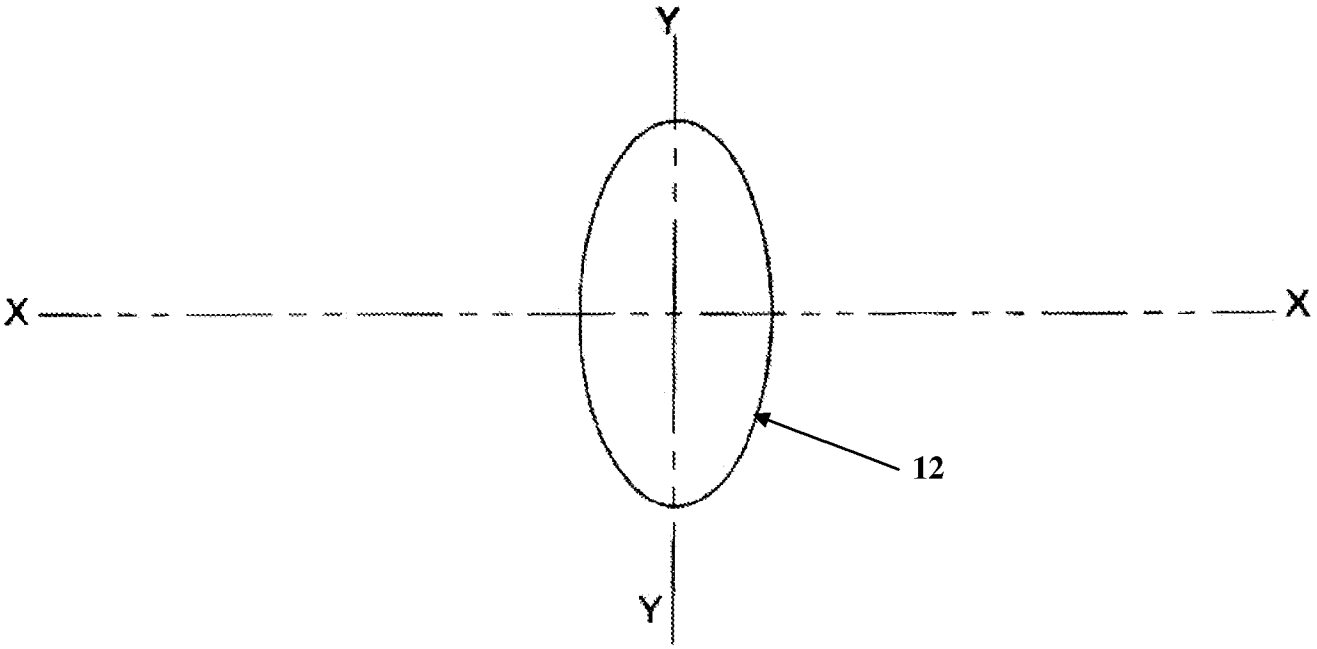
FIG. 13 exemplarily illustrates a top view of a single elliptical bristle.

As exemplarily illustrated in FIG. 5, an oval bristle 16 with an oval configuration has opposing, substantially parallel sides 22 and opposing radial ends 24, and as exemplarily illustrated in FIG. 6, an elliptical bristle 12 with an elliptical configuration has a continuous, non-circular curvature. FIG. 13 exemplarily illustrates a top view of a single elliptical bristle 12. As known in the art and as exemplarily illustrated in FIG. 13, an elliptically configured bristle 12 has a semi-major axis YY and a semi-minor axis XX.

An ellipse has a first focus point and a second focus point, collectively referred to as "foci", along the semi-major axis YY. The foci of the ellipse are equidistant from the center point. The eccentricity of an ellipse is the ratio of the distance between the two foci to the length of the major axis. For an ellipse, the eccentricity is between 0 and 1. When the eccentricity is 0, the foci coincide with the center point and the figure is a circle. As the eccentricity tends towards 1, the ellipse gets a more elongated shape. The ellipse tends towards a line segment. For the toothbrush apparatus 100 disclosed herein, the elliptical bristles 12 that have an elliptical configuration have an eccentricity greater than zero to exclude circular configurations. The degree of elongation can be varied in the toothbrush apparatus 100 disclosed herein.

The toothbrush apparatus 100 disclosed herein has several embodiments, all with non-circular bristles that are functional to varying degrees.

FIG. 1 exemplarily illustrates a plan view of an embodiment of the toothbrush apparatus 100, where bristles 12 are arranged in elliptical bundles 101 along a longitudinal axis XX. The plan view exemplarily illustrated in FIG. 1 is simplified for demonstrative purposes. The XX axis of FIG. 1 represents the longitudinal axis of the toothbrush apparatus 100 which would also include a toothbrush handle 14 (only connective portion shown) that is integral with a toothbrush head 10. Each of the elliptical bristles 12 has a semi-major axis parallel to the longitudinal axis XX of FIG. 1. For demonstrative purposes only, FIG. 1 depicts the general orientation of individual elliptical bristles 12.

Figure 2:
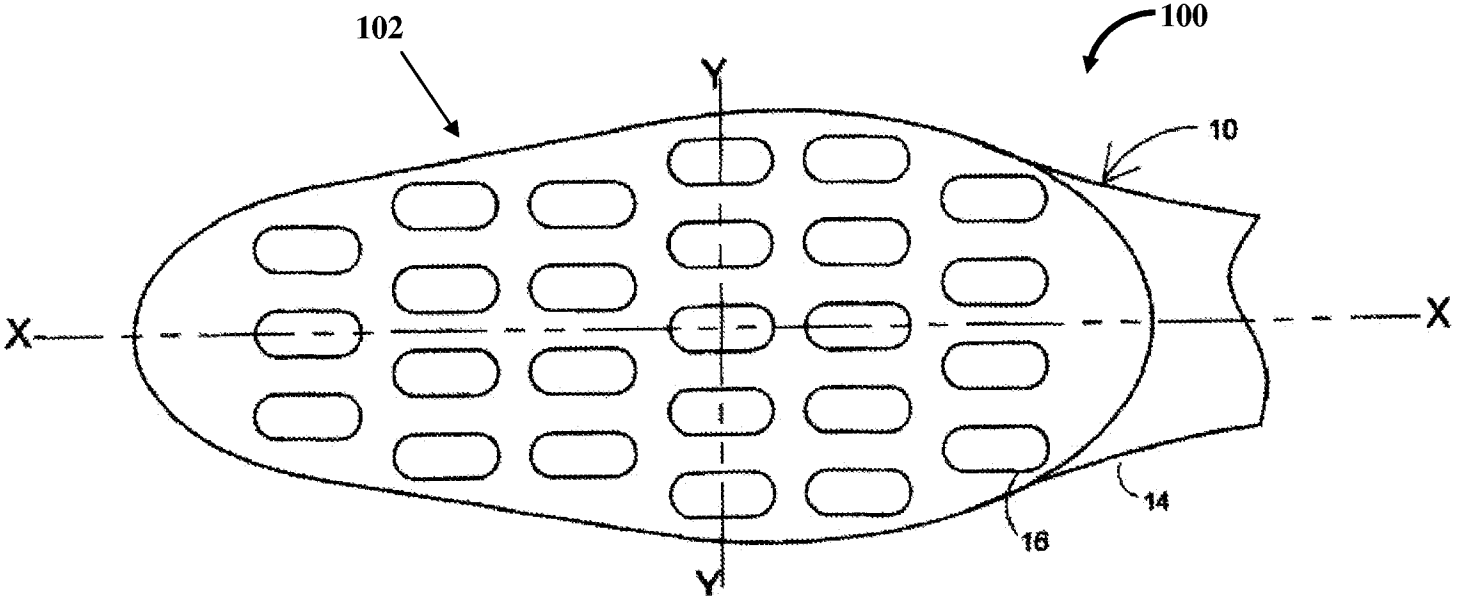
FIG. 2 exemplarily illustrates a plan view of an embodiment of the toothbrush apparatus, where bristles are arranged in oval bundles along a longitudinal axis XX.

FIG. 2 exemplarily illustrates a plan view of an embodiment of the toothbrush apparatus 100, where bristles 16 are arranged in oval bundles 102 along a longitudinal axis XX. The plan view exemplarily illustrated in FIG. 2 is simplified for demonstrative purposes. The XX axis of FIG. 2 represents the longitudinal axis of the toothbrush apparatus 100 which would also include a toothbrush handle 14 (only connective portion shown) that is integral with the toothbrush head 10. Each of the oval bristles 16 has a longitudinal axis parallel to longitudinal axis XX of FIG. 2. For demonstrative purposes only, FIG. 2 depicts the general orientation of individual oval bristles 16.

Figure 3:
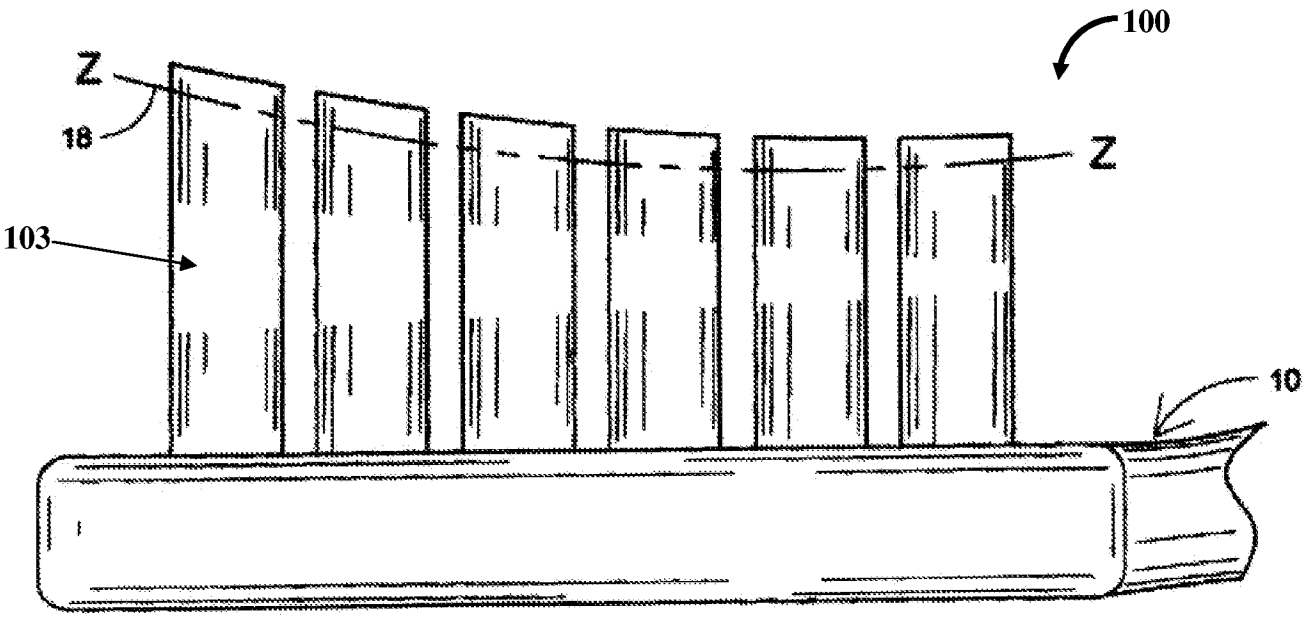
FIG. 3 exemplarily illustrates a side view of a toothbrush head of the toothbrush apparatus, showing a curved profile of bristles of predetermined heights.
Figure 4:
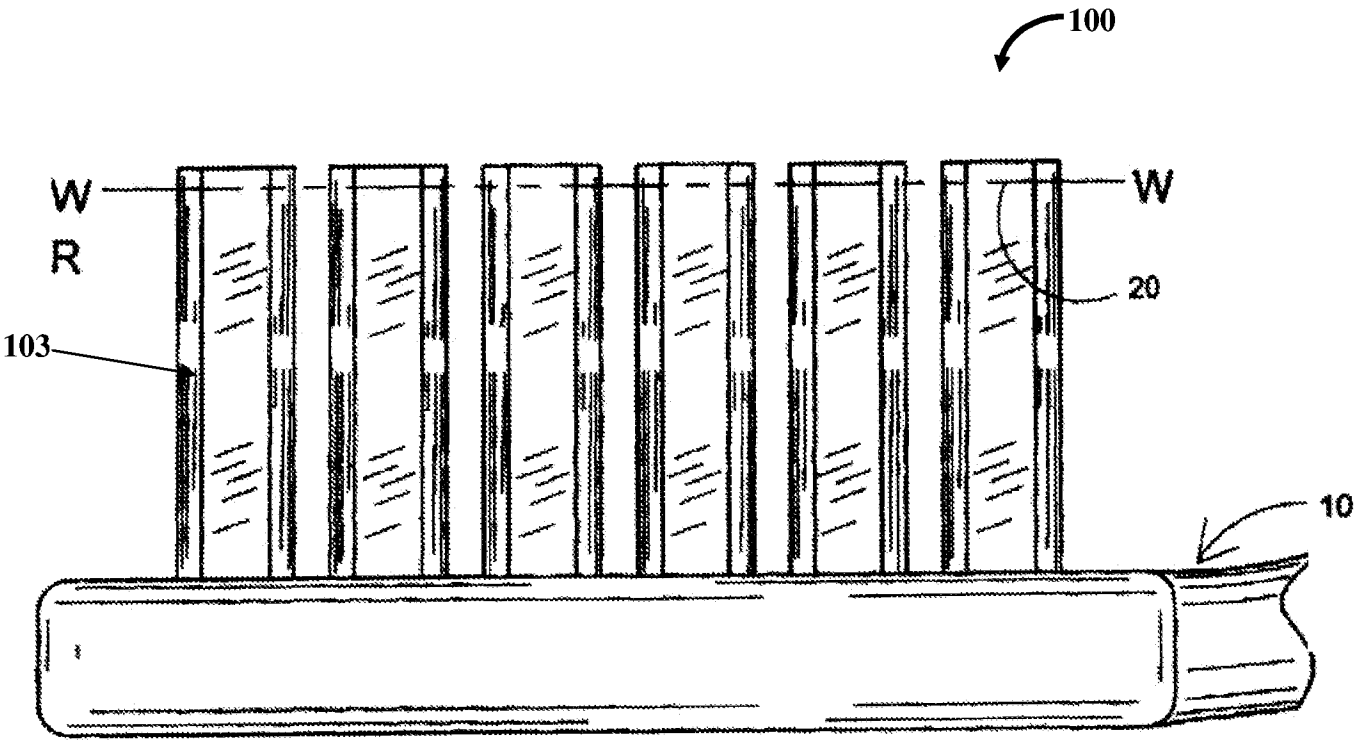
FIG. 4 exemplarily illustrates a side view of the toothbrush head of the toothbrush apparatus, showing a horizontal profile of bristles of uniform heights.

FIGS. 3-4 exemplarily illustrate side views of the toothbrush head 10 of the toothbrush apparatus 100 exemplarily illustrated in FIG. 1. FIG. 3 shows a curved profile 18 of bristles 103 of predetermined heights. FIG. 4 shows a horizontal profile 20 of bristles 103 of uniform heights. FIG. 3 and FIG. 4 demonstrate that the bristle arrangements 18 and 20 of the toothbrush apparatus 100 include bristle ends that form a curved profile 18 along a curved line ZZ and bristle ends that form a horizontal profile 20 along a straight line WW respectively.

Figure 7A:
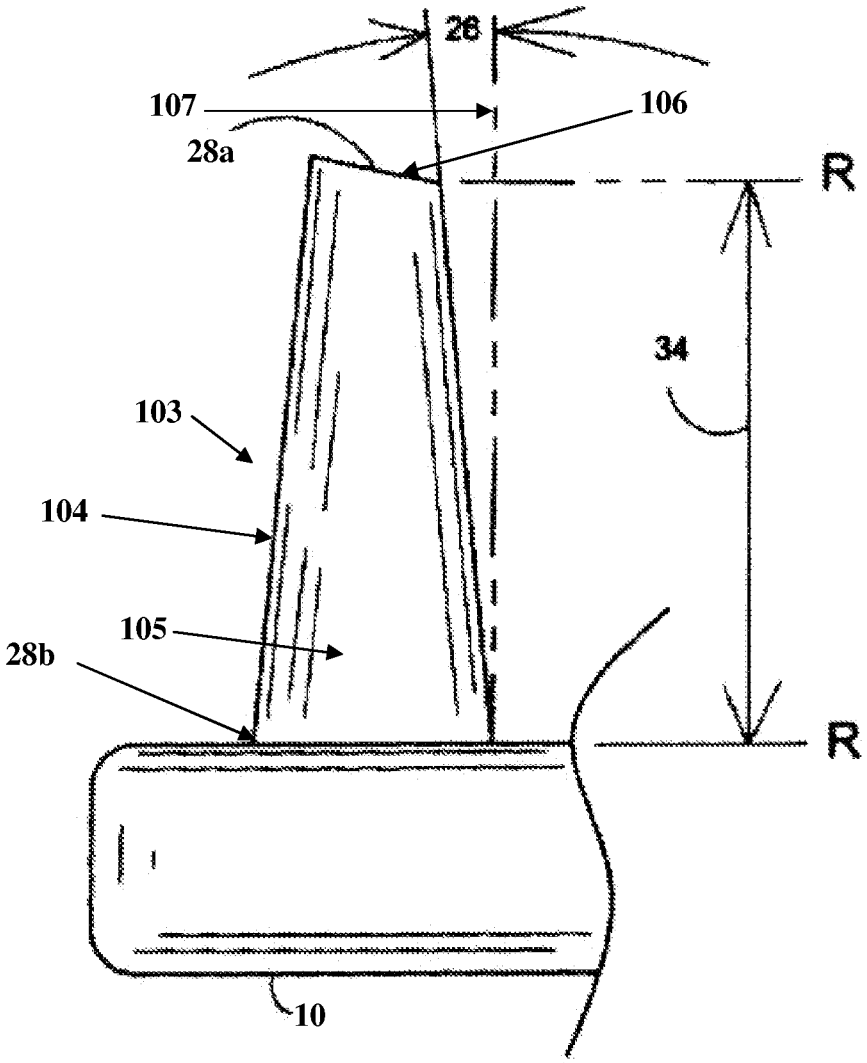
FIG. 7A exemplarily illustrates a partial side view of a single bristle with a chisel end.
Figure 7B:
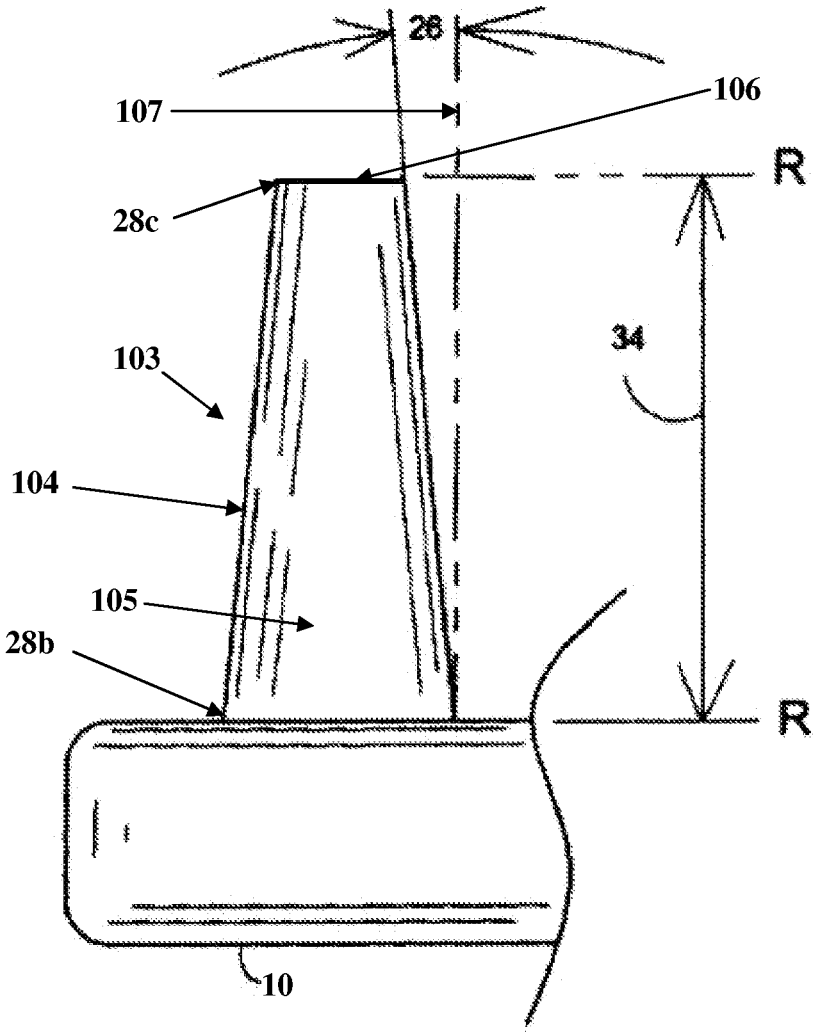
FIG. 7B exemplarily illustrates a partial side view of a single bristle with a straight horizontal end.

FIGS. 7A-7B exemplarily illustrate partial side views of a single bristle 103. FIG. 7A shows a single bristle 103 on the toothbrush head 10 in which the single bristle 103 which has a second end 28*a* configured as a chisel end moves with an angular offset 26 based on height 34 of the single bristle 103. The angular offset 26 can be varied as desired in order to improve efficiency of brushing without undue application of force. The bristle 103 disclosed herein comprises an elongated bristle body 104 and a wall 105. The elongated bristle body 104 has a first end also referred to as a base end 28*b*, and a second end 28*a* or 28*c* opposing the base end 28*b*. The wall 105 defines the elongated bristle body 104. The wall 105 continuously tapers from the base end 28*b* towards the second end 28*a* or 28*c*. The base end 28*b* of the elongated bristle body 104 is adapted to be attached to the toothbrush head 10. In an embodiment, the cross section of the elongated bristle body 104 at the base end 28*b* is greater than the cross section of the elongated bristle body 104 at the second end 28*a* or 28*c*. In an embodiment, the second end 28*c* of the elongated bristle body 104 defines a plane surface 106, where the plane surface 106 is perpendicular to a line 107 extending along the length 34 of the elongated bristle body 104 as exemplarily illustrated in FIG. 7B. FIG. 7B shows a single bristle 103 with a straight horizontal second end 28*c*. In another embodiment, the plane surface 106 of the second end 28*a* is inclined with respect to a line 107 extending along the length 34 of the elongated bristle body 104 as exemplarily illustrated in FIG. 7A.

Figure 8:
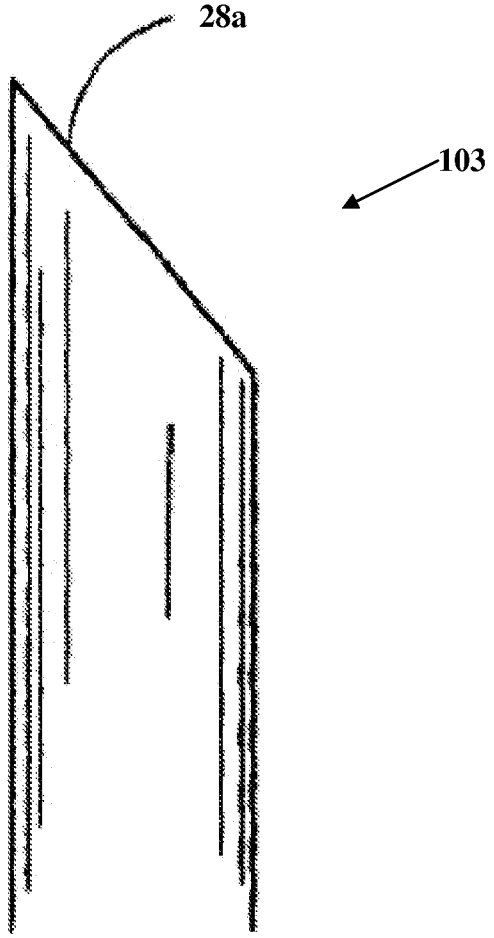
FIG. 8 exemplarily illustrates a partial side view of a single bristle with a chisel end.
Figure 9:
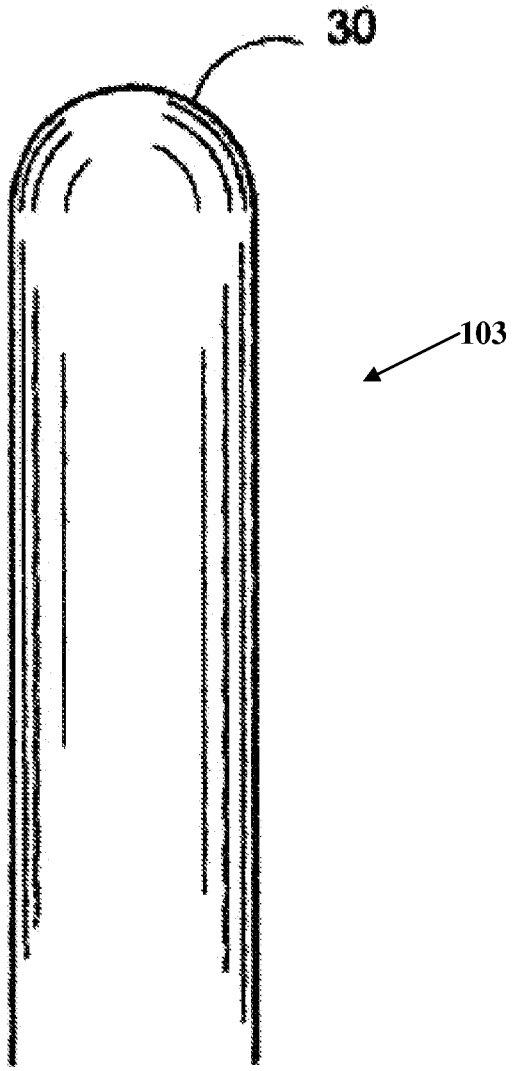
FIG. 9 exemplarily illustrates a partial side view of a single bristle with a round tip.
Figure 10:
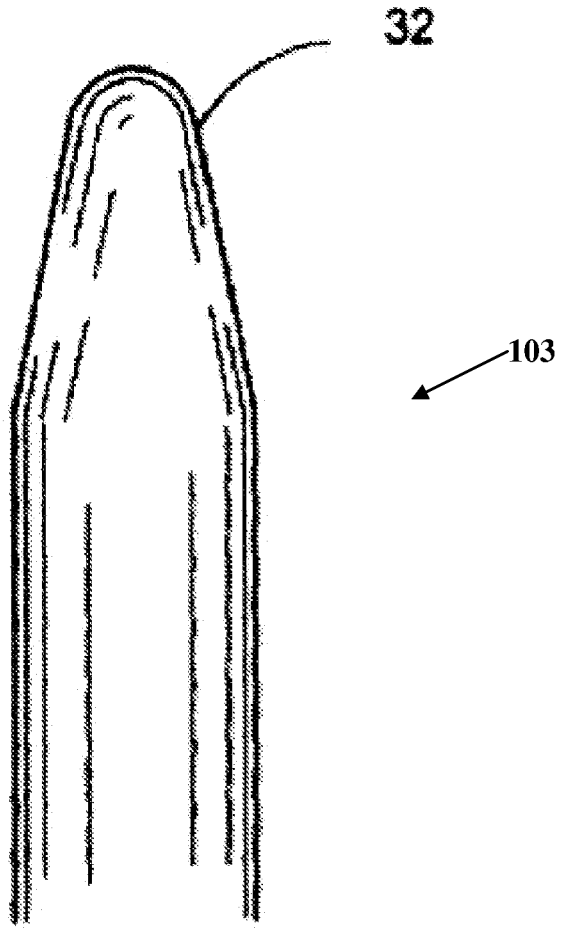
FIG. 10 exemplarily illustrates a partial side view of a single bristle with a tapered tip.

FIG. 8, FIG. 9, and FIG. 10 exemplarily illustrate partial side views of a single bristle 103 with a chisel end 28*a*, a round tip 30, and a tapered tip 32 respectively. FIGS. 8-10 show that the toothbrush apparatus 100 is operable with varying end configurations comprising, for example, a chisel end 28*a* as shown in FIG. 8, a round tip 30 as shown in FIG. 9, and a tapered tip 32 as shown in FIG. 10.

Figure 11:
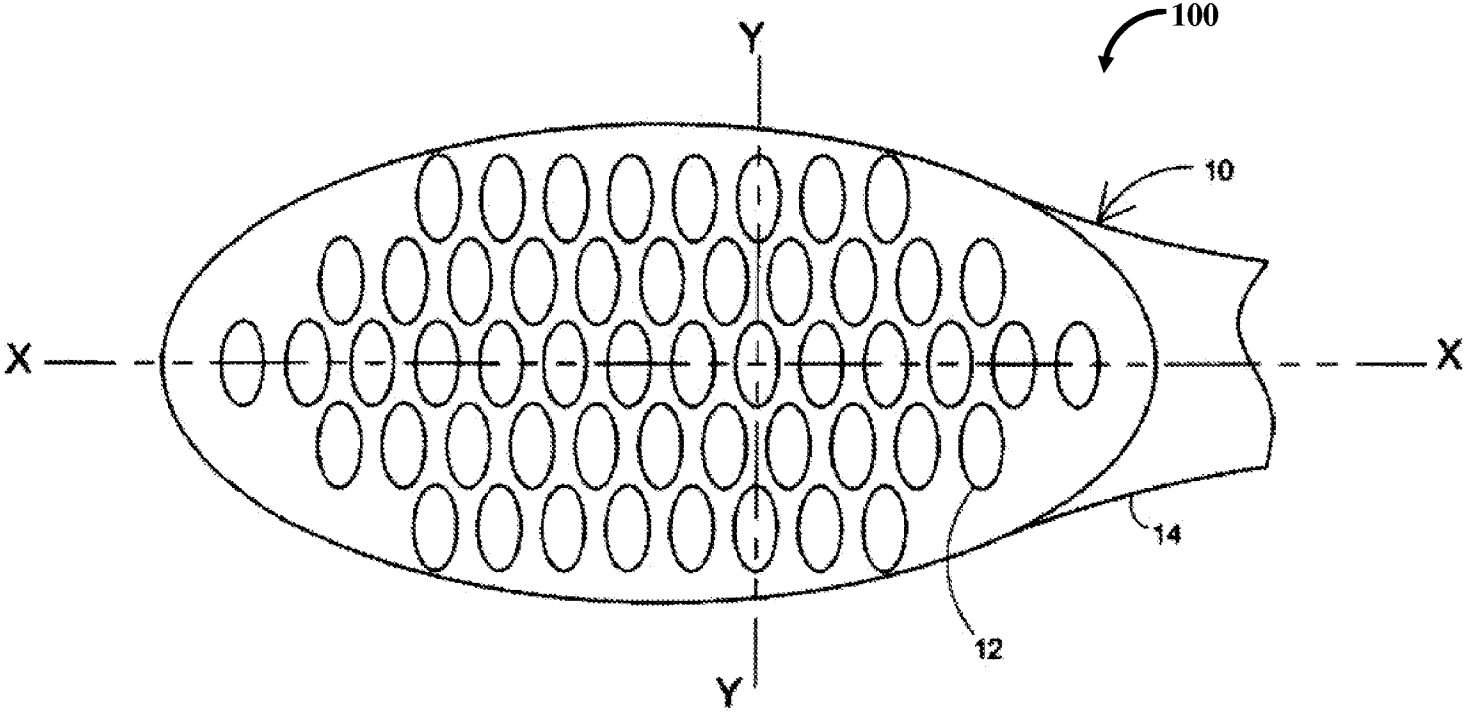
FIG. 11 exemplarily illustrates a plan view of the toothbrush head of the toothbrush apparatus having elliptical bristles arranged perpendicular to a longitudinal axis XX.

FIG. 11 exemplarily illustrates a plan view of the toothbrush head 10 of the toothbrush apparatus 100 having elliptical bristles 12 arranged perpendicular to a longitudinal axis XX. FIG. 11 depicts a demonstrative embodiment of the toothbrush apparatus 100, showing the orientation of individual elliptical bristles 12 oriented with a semi-major axis YY that is perpendicular to the longitudinal axis XX of the toothbrush head 10.

Figure 12:
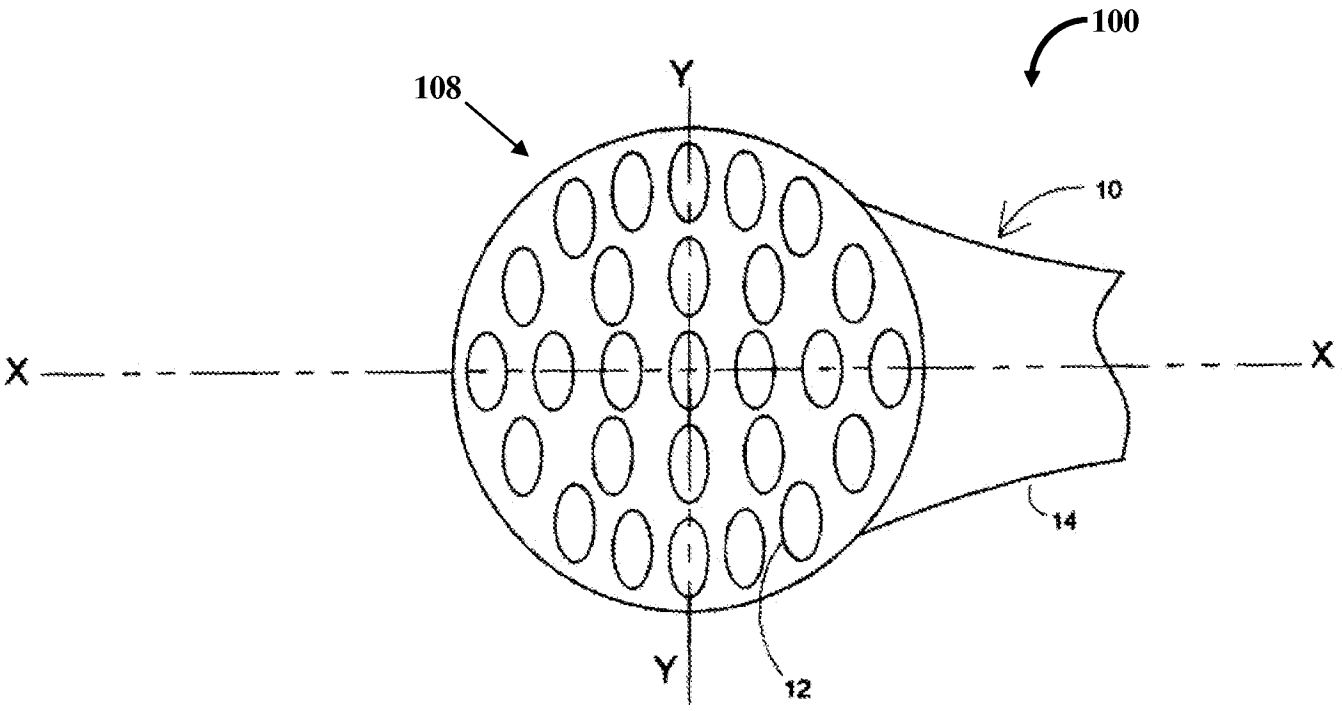
FIG. 12 exemplarily illustrates an expanded view showing arrangements of individual elliptical bristles of the toothbrush apparatus in a circular bundle.

FIG. 12 exemplarily illustrates an expanded view showing arrangements of individual elliptical bristles 12 of the toothbrush apparatus 100 in a circular bundle 108. FIG. 12 shows a single circular bundle 108 of elliptical bristles 12 in a circular bristle socket. The individual bristles 12 are elliptical, but the bundle 108 is circular. In this embodiment, the semi-major axis YY of each of the elliptical bristles 12 is perpendicular to the longitudinal axis XX of the toothbrush head 10.

The toothbrush apparatus 100 disclosed herein overcomes a deficiency in the art, namely, current circular bristles result in damage to the teeth when an over application of force is applied by the user. Utilization of non-circular bristles disclosed herein provides a different distribution of force and allows teeth to be effectively brushed with reduced pressure and force on tooth surfaces.

In an embodiment, the bristle fiber disclosed herein with a non-circular cross section can be used in combination with bristle fibers having round cross sections, where non-circular type of bristles, for example, 12 and 16 exemplarily illustrated in FIGS. 1-2, are used in a part of the region of the toothbrush area, while in other regions, round cross section bristles are used. That is, the distal end of the bristle is non-circular and the remaining section of the bristle is circular. As used herein, the phrase "remaining section" refers to any remaining portion that is not at or near the distal end.

Figures 14A, 14B:
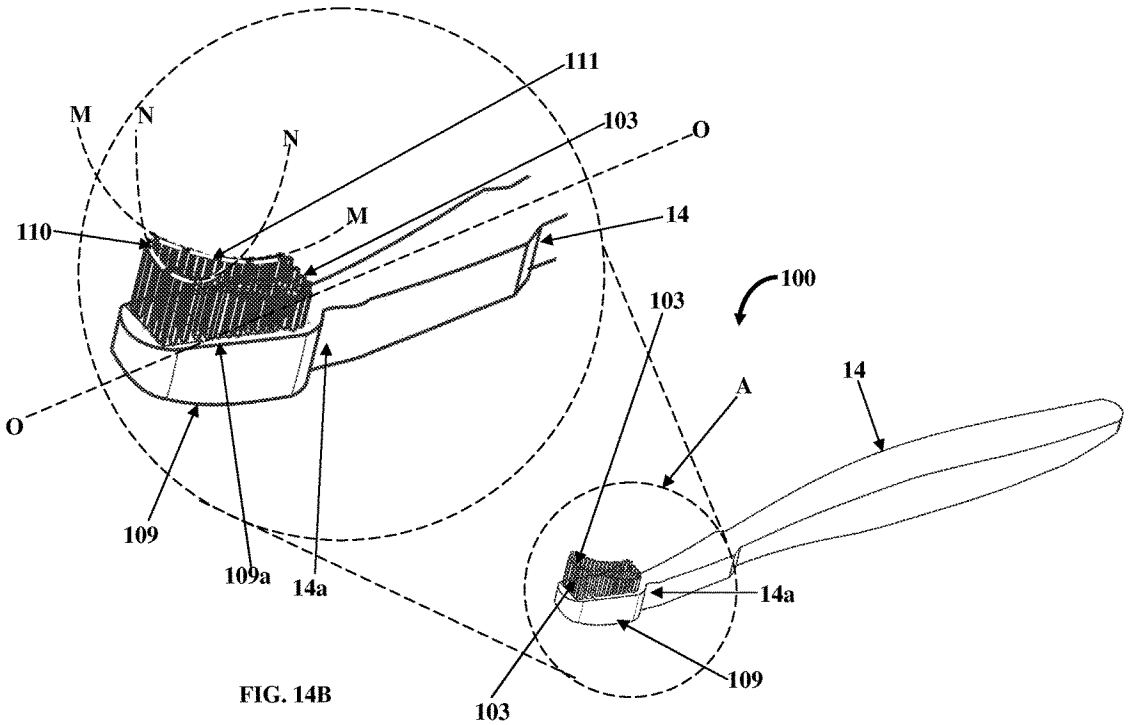
FIG. 14A exemplarily illustrates a top perspective view of an embodiment of the toothbrush apparatus with an arcuate toothbrush head.
FIG. 14B exemplarily illustrates an enlarged view of a portion A of the embodiment of the toothbrush apparatus shown in FIG. 14A.

FIG. 14A exemplarily illustrates a top perspective view of an embodiment of the toothbrush apparatus 100 with an arcuate toothbrush head 109. FIG. 14B exemplarily illustrates an enlarged view of a portion A of the embodiment of the toothbrush apparatus 100 shown in FIG. 14A. The toothbrush apparatus 100 disclosed herein comprises a toothbrush handle 14, a generally arcuate toothbrush head 109 configured at a distal end 14*a* of the toothbrush handle 14, and bristles 103 fixedly attached on an upper surface 109*a* of the arcuate toothbrush head 109. The bristles 103 form a first curved trim profile 111 represented by a curved line MM along a longitudinal axis OO of the toothbrush apparatus 100, and a second curved trim profile 110 represented by a curved line NN substantially perpendicular to the longitudinal axis OO of the toothbrush apparatus 100 as disclosed in the detailed description of FIG. 15. As used herein, the phrase "curved trim profile" refers to a curved profile defined by trimming distal ends of a cluster of bristles 103. In an embodiment, for orthodontic patients, the bristles 103 can be trimmed to accommodate the shape of brackets on a tooth surface.

Figure 15:
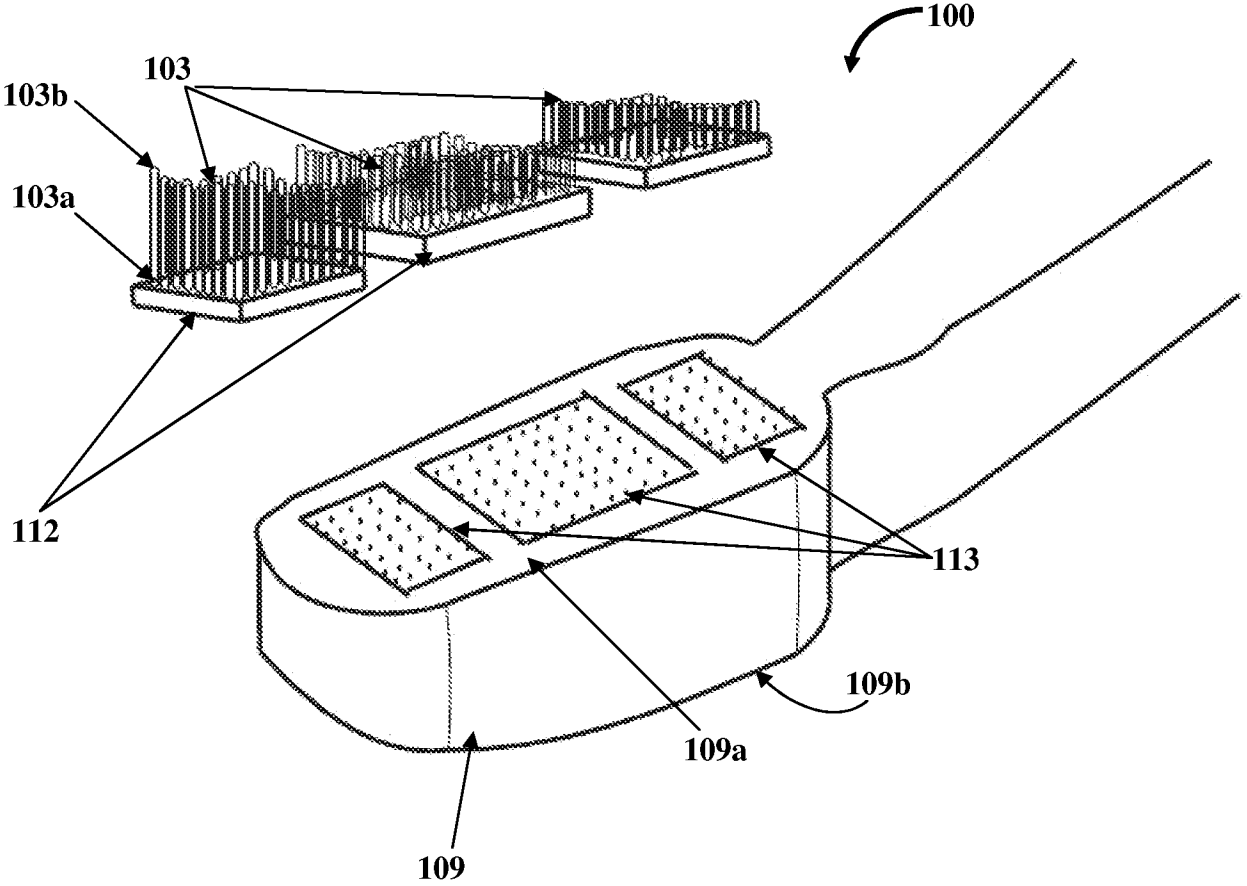
FIG. 15 exemplarily illustrates a partial exploded view of the embodiment of the toothbrush apparatus shown in FIG. 14A.

FIG. 15 exemplarily illustrates a partial exploded view of the embodiment of the toothbrush apparatus 100 shown in FIG. 14A. In this embodiment, the toothbrush apparatus 100 disclosed herein comprises a generally arcuate toothbrush head 109, one or more bristle carriers 112, and multiple bristles 103. The arcuate toothbrush head 109 conforms to a dental arch 114 as exemplarily illustrated in FIGS. 17A-17B. As used herein, the phrase "dental arch" refers to a curved orientation of teeth on an upper jaw and a lower jaw of a mouth. The arcuate toothbrush head 109 comprises one or more base sections 113 on an upper surface 109*a* of the arcuate toothbrush head 109. The bristle carriers 112 are detachably attached to the base sections 113 on the upper surface 109*a* of the arcuate toothbrush head 109. The bristles 103 of predetermined heights are attached to each of the bristle carriers 112. The bristles 103 can be inserted into the bristle carriers 112, and then these bristle carriers 112 can be inserted into the base sections 113 on the upper surface 109*a* of the arcuate toothbrush head 109 as individual blocks. In the manufacturing process of the toothbrush apparatus 100, the attachment or insertion of the bristles 103 on the bristle carriers 112 avoids the bristle insertion process on the arcuate toothbrush head 109, thereby providing a flexible method of bristle insertion. Each bristle 103 has a first end 103*a* and an opposing second end 103*b*. The first end 103*a* of each bristle 103 is attached to the bristle carriers 112. The second end 103*b* of each of the bristles 103 of predetermined heights defines a first curved trim profile 111 along a longitudinal axis OO of the toothbrush apparatus 100 as exemplarily illustrated in FIG. 16A, and a second curved trim profile 110 substantially perpendicular to the longitudinal axis OO of the toothbrush apparatus 100 as exemplarily illustrated in FIG. 16B. In an embodiment, the base sections 113 are provided on the lower surface 109*b* of the arcuate toothbrush head 109 and made of a rubber type material for use as a soft tissue scraper and cleaner.

Figure 16A:
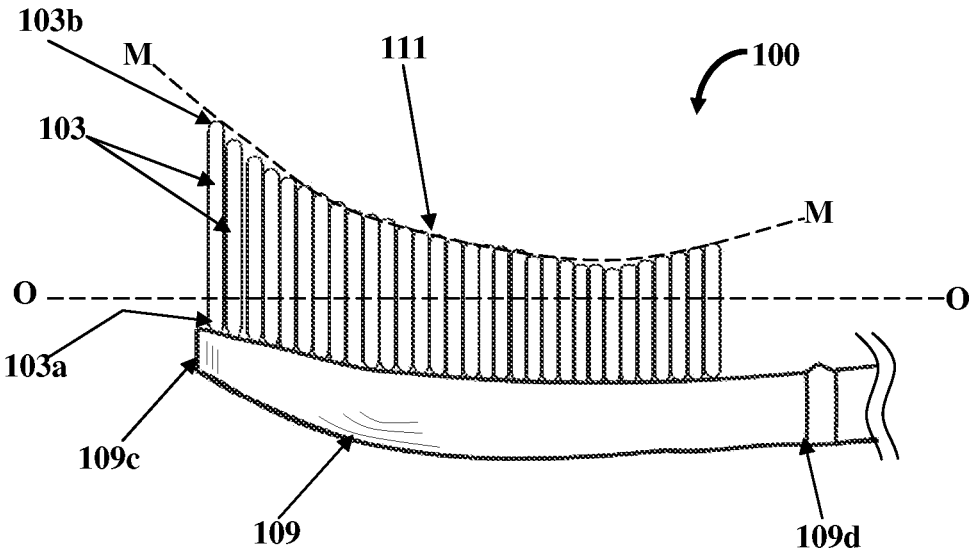
FIG. 16A exemplarily illustrates a side elevation view of the embodiment of the toothbrush apparatus shown in FIG. 14A.
Figure 16B:
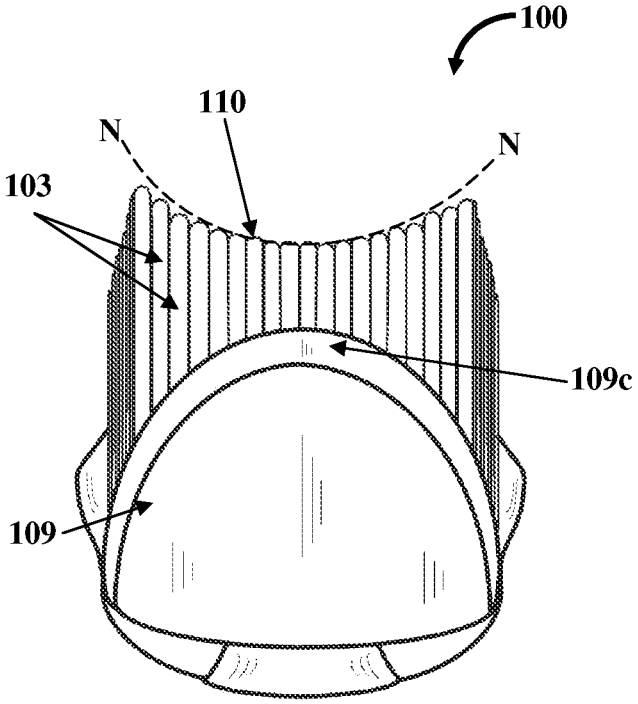
FIG. 16B exemplarily illustrates a front elevation view of the embodiment of the toothbrush apparatus shown in FIG. 14A.

FIGS. 16A-16B exemplarily illustrate a side elevation view and a front elevation view of the embodiment of the toothbrush apparatus 100 shown in FIG. 14A, respectively. The bristles 103 in the first curved trim profile 111 positioned proximal to an opposing end 109*d* of a terminal end 109*c* of the arcuate toothbrush head 109 are of heights lower than heights of the bristles 103 positioned proximal to the terminal end 109*c* of the generally arcuate toothbrush head 109. In an embodiment, the arcuate toothbrush head 109 is of a curvedly tapering thickness towards the terminal end 109*c* of the arcuate toothbrush head 109 along the longitudinal axis OO of the toothbrush apparatus 100. The terminal end 109*c* of the arcuate toothbrush head 109 is narrow and flexible to enable a user to reach rear teeth 115, for example, molar teeth as exemplarily illustrated in FIGS. 17A-17B. The second curved trim profile 110 extends over the terminal end 109*c* of the arcuate toothbrush head 109.

Figure 17A:
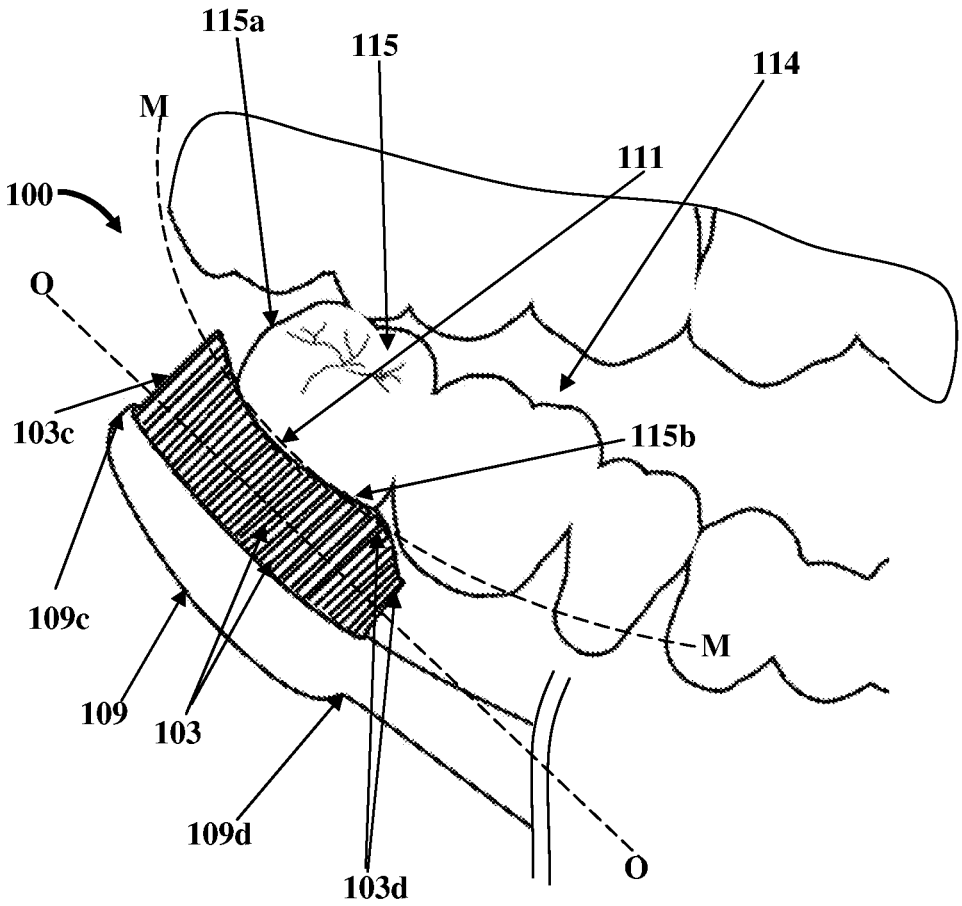
FIG. 17A exemplarily illustrates an application of the embodiment of the toothbrush apparatus shown in FIG. 14A on a rear section of rear teeth.
Figure 17B:
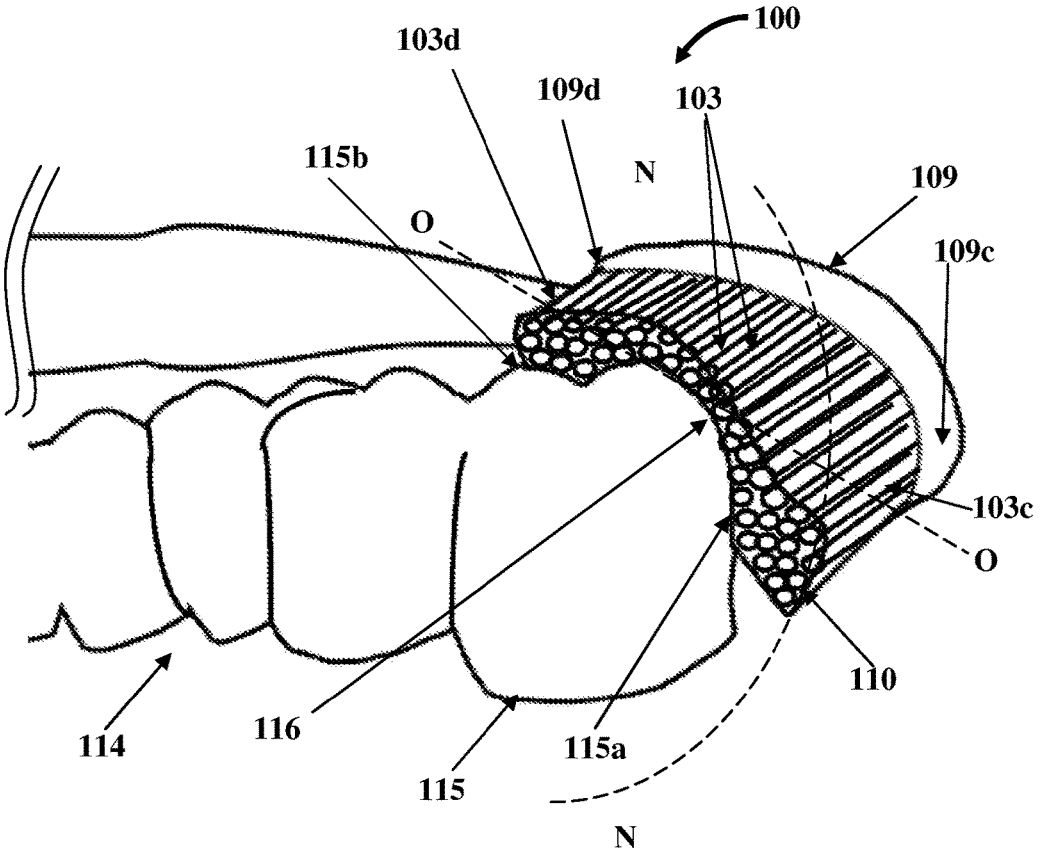
FIG. 17B exemplarily illustrates an application of the embodiment of the toothbrush apparatus shown in FIG. 14A on a frontal section of rear teeth.

FIGS. 17A-17B exemplarily illustrate an application of the embodiment of the toothbrush apparatus 100 shown in FIG. 14A on a rear section 115*a* of rear teeth 115 and on a frontal section 115*b* of the rear teeth 115 respectively. The bristles 103 in the first curved trim profile 111 along the curved line MM, positioned proximal to the terminal end 109*c* of the arcuate toothbrush head 109, are configured to extend in a narrow and flexible manner to reach a rear section 115*a* of the rear teeth 115 along the dental arch 114. The longer bristles 103*c* are disposed at the terminal end 109*c* of the arcuate toothbrush head 109 to reach behind the rear teeth 115. The bristles 103 in the first curved trim profile 111 proximal to the opposing end 109*d* of the terminal end 109*c* of the arcuate toothbrush head 109 are configured to reach the frontal section 115*b* of the rear teeth 115. Shorter bristles 103*d* are disposed at the opposing end 109*d* of the terminal end 109*c* of the arcuate toothbrush head 109 to reach the frontal section 115*b* of the rear teeth 115. As exemplarily illustrated in FIG. 17B, in an embodiment, the second curved trim profile 110 which is substantially perpendicular to the longitudinal axis OO of the toothbrush apparatus 100 is configured to conform to a surface curvature 116 of teeth.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials, and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

We claim:

1. A toothbrush apparatus comprising:

a generally arcuate toothbrush head, said generally arcuate toothbrush head substantially conforms to a dental arch, said generally arcuate toothbrush head comprising one or more base sections on an upper surface of said generally arcuate toothbrush head;

one or more bristle carriers detachably attached to said one or more base sections on said upper surface of said generally arcuate toothbrush head; and a plurality of bristles of predetermined heights attached to each of said one or more bristle carriers, each of said bristles having a first end and an opposing second end, wherein said first end of said each of said bristles is attached to said one or more bristle carriers, wherein said second end of said each of said bristles of said predetermined heights defining a first curved trim profile along a longitudinal axis of said toothbrush apparatus, and a second curved trim profile substantially perpendicular to said longitudinal axis of said toothbrush apparatus, wherein said bristles in said first curved trim profile positioned proximal to a terminal end of said generally arcuate toothbrush head extend to reach a rear section of rear teeth along said dental arch, and wherein said bristles in said first curved trim profile positioned proximal to an opposing end opposite to said terminal end of said generally arcuate toothbrush head are of heights lower than heights of said bristles positioned proximal to said terminal end of said generally arcuate toothbrush head to reach a frontal section of said rear teeth.

2. The toothbrush apparatus of claim 1, wherein said second curved trim profile substantially perpendicular to said longitudinal axis of said toothbrush apparatus substantially confirms to a surface curvature of teeth.

3. The toothbrush apparatus of claim 1, wherein said generally arcuate toothbrush head is of a curvedly tapered thickness towards said terminal end of said generally arcuate toothbrush head along said longitudinal axis of said toothbrush apparatus.

* * * * *